US006543064B1

(12) United States Patent
Prall et al.

(10) Patent No.: US 6,543,064 B1
(45) Date of Patent: Apr. 8, 2003

(54) URINATION DEVICE

(76) Inventors: Paul Prall, Blumenstrasse 16, Petershausen (DE), D-85238; Elke Petra, Lärchenstrasse 28, Anzing (DE), D-85646; Gert Gottsmann, Gräfelfinger Str. 50, München (DE), D-81375

( * ) Notice: Subject to any disclaimer, the term of this patent is extended or adjusted under 35 U.S.C. 154(b) by 0 days.

(21) Appl. No.: 09/786,849

(22) PCT Filed: Sep. 9, 1999

(86) PCT No.: PCT/DE99/02854

§ 371 (c)(1),
(2), (4) Date: Jun. 18, 2001

(87) PCT Pub. No.: WO00/13644

PCT Pub. Date: Mar. 16, 2000

(30) Foreign Application Priority Data

Sep. 9, 1998 (DE) ..... 198 41 278

(51) Int. Cl.[7] ..... A47K 11/00
(52) U.S. Cl. ..... 4/144.1
(58) Field of Search ..... 4/144.1–144.4; 604/317, 346, 347

(56) References Cited

U.S. PATENT DOCUMENTS

| | | | | | |
|---|---|---|---|---|---|
| 703,131 | A | * | 6/1902 | Jaenel | 4/144.3 |
| 2,815,511 | A | * | 12/1957 | Friedman et al. | 4/144.1 |
| 3,099,840 | A | * | 8/1963 | Johnson | 4/144.1 |
| 3,163,869 | A | * | 1/1965 | Johnson et al. | |
| 3,415,299 | A | * | 12/1968 | Hinman, Jr. et al. | 4/144.1 |
| 3,422,463 | A | * | 1/1969 | Lowry | |
| 3,725,962 | A | * | 4/1973 | Gouget | |
| 3,927,426 | A | * | 12/1975 | Geddes | 4/144.3 |
| 4,091,476 | A | * | 5/1978 | DeBurgh | |
| 4,117,845 | A | * | 10/1978 | Brown | |
| 4,769,858 | A | * | 9/1988 | Gamm et al. | 4/144.1 |
| 5,926,858 | A | * | 7/1999 | Heller | 4/144.1 |
| 5,953,763 | A | * | 9/1999 | Gouget | 4/144.1 |

FOREIGN PATENT DOCUMENTS

| | | | |
|---|---|---|---|
| DE | 32 38 989 | A1 * | 6/1983 |
| DE | 93 17 372.5 | U1 * | 4/1994 |
| DE | 297 00 124 | U1 * | 4/1997 |

* cited by examiner

*Primary Examiner*—Charles R. Eloshway
(74) *Attorney, Agent, or Firm*—Ostrolenk, Faber, Gerb & Soffen, LLP

(57) ABSTRACT

A urination device including a collecting container, which has a cylindrical inlet connector projecting upward at an angle form a first end and an end wall at a second end with an outlet connector at a bottom edge, and a urine bag. An inlet hose, which opens into the urine bag, is connected in a detachable manner to the outlet connector, the collecting container has an essentially cylindrical hollow body with an inlet-side end wall and an outlet-side end wall essentially perpendicular to a longitudinal axis of the container and with relatively small dimensions. The cylindrical inlet connector in the inlet-side end wall is arranged to project upward from an off-center point on the wall, diagonally opposite a point where the outlet connector is installed in the outlet-side end wall. The inlet connector is no more than ⅓ a length of the collecting container and forms an angle of about 20° to the axis of the container. A top front edge projects radially beyond an edge of the body of the collecting container no more than slightly.

20 Claims, 4 Drawing Sheets

URINATION DEVICE

PRIORITY CLAIM

This is a U.S. national stage of application No. PCT/DE99/02854, filed on Sep. 9, 1999. Priority is claimed on that application and on the following application: Country: Germany, Application No.: 198 41 278.9, Filed: Sep. 9, 1998.

BACKGROUND OF THE INVENTION

The invention pertains to a urination device of the type used by, for example, bedridden and/or incontinent patients.

It is generally known that male bedridden patients in particular use a urine bottle to urinate in, this bottle being nicknamed the "duck". The bottle has a wide, relatively flat body, with a tubular neck or inlet section which extends upward at a steep angle. Aside from the fact that the rigid, wide body of the bottle is unpleasant to use in terms of temperature and hardness and forces the patient to spread his legs out quite widely, the degree to which it can be filled is not optimal, because, when the bottle is full, its contents reach all the way up into the inlet section, which means that the contents can easily spill out. Even if the bottle is only ¾ full, it must be pulled back and tipped vertically as it is being removed, because otherwise the contents will slosh out. The long projecting neck can be used as a grip so that the bottle can tipped downward and emptied.

DE 3,238,989 A1 describes a urination device which consists essentially of a relatively long urine line, to one end of which a drainless urine collecting bag is attached. A catheter or an external urine collection device such as a condom-like urine collector for men or a urine collecting funnel for women is connected to the other end. To ensure good flow through the relatively long urine line, a relatively complicated vent system is provided. So that the valveless bag can be emptied, its plug must be removed. Thus the urine which has entered the bag can escape from the device if it is improperly handled. In practice, the device can be used only in a preferably vertical position, that is, while the person is standing. Nor can the device be used more than once; it cannot, for example, be used during the night, set aside horizontally, and used again without spilling the contents.

DE 297-00,124 U1 describes a urine bottle with a hose connector for (any suitable) catheter bag and a hanger. The collecting container is a narrow cylinder, open at the top, which has at the other end a funnel-like shape leading to a hose connector in the center, to which a catheter bag is attached via a connecting hose. This known urination device can be used only while the tube is in a vertical or only slightly tilted position, that is, only while the person is standing or possibly also while sitting, but not lying down.

The "urinal" described in U.S. Pat. No. 4,121,306 consists of a relatively long, slender, funnel-shaped collecting body with a wedge-like stand for holding the collector at a slant, e.g., in bed. A long hose, which leads to a urine container, is attached to the narrow outlet end of the funnel. A sample container can also be attached between the funnel and the container. This known urinal is not suitable for independent use by a bedridden patient.

Finally, D 93-17,372.5 U1 describes a urine bottle of the "duck" type, that is, with a relatively long, steeply upward-slanting, forward-pointing neck, of the conventional, bulky design. At the bottom distal edge of the bottle, a small drain tube is attached, which is connected to a long hose, which leads to or is inserted in a large collecting container in a low position, e.g., under the bed. This urine bottle is suitable for use only by recumbent male patients with continuous incontinence, for which purpose it is equipped with a very wide bottom support surface. It is not suitable for convenient and reliable use by bedridden patients who are basically healthy but are suffering only from slight incontinence after surgery or for use by healthy individuals who are using the urine bottle during the night, for the sake of convenience, for example. Especially because of its size and the very prominently projecting neck, this bottle, too, is extremely inconvenient to handle and is also unreliable. This bottle cannot be easily carried along on trips without taking up a great deal of space, nor can it be used in a motor vehicle or by handicapped wheelchair users.

SUMMARY OF THE INVENTION

The task of the invention is therefore to provide a urination device which is simple, hygienic, and reliable in design and handling, which allows independent reuse by the user himself without intermediate emptying, and which especially can be taken along and used on trips with optimum convenience.

Accordingly, the urination device according to the invention consists of a collecting container, which is designed as an essentially cylindrical, hollow body with two end walls essentially perpendicular to its longitudinal axis. In addition, the collecting container has relatively small dimensions, preferably a diameter of approximately 70 mm and a length of approximately 150 mm. The inlet connector, furthermore, is no more than ⅓ the length of the body of the collecting container and is diagonally opposite the attachment point of the outlet connector, thus being off-center toward the top and tilted by an angle of only about 20° to the inlet-side end wall, the upper front edge of the inlet connector projecting no more than slightly in the radial direction beyond the upper edge of the body of the collecting container. As a result, a collecting container is provided which is relatively small and handy, so that it is extremely easy to manage and can be packed and taken along on trips without taking up much room.

Finally, to serve as a holding container, a flat, soft, flexible urine bag, known in and of itself, is connected in an easily attachable and detachable manner to the outlet connector of the collecting container. Thus at least a large percentage of the. urine flows immediately into the urine bag right during the urination process itself; then, by holding onto the collecting container and raising the urination device, it is possible to ensure that virtually all of the rest of the urine will flow into the urine bag, which is provided with an inlet valve. Then the entire urination device can simply be set down on a horizontal surface without fear that even a single drop of urine will spill out or otherwise escape.

It is especially advantageous to provide an easy-to-grasp, upward- projecting positioning nipple at the top edge of the inlet end of the collecting container body, that is, at the edge which is at the top when the device is being used. This has the effect of ensuring that the collecting container and thus the entire urination device are always in the correct position when used, that is, that the inlet connector will be at the top and the outlet connector at the bottom. This guarantees optimal inflow and outflow of the urine and eliminates the danger of spillage.

It is also advantageous to reduce the length of the inlet hose of the urine bag to a length of no more than 10 cm and to push this hose directly onto the outlet connector of the collecting container, this outlet connector being designed as a hose connector with an outside surface which tapers down either conically or in a series of step-like graduations.

Between the outlet connector and the urine bag (or the short inlet hose of the urine bag) it is advantageous to provide a soft, elastic connecting hose, which is itself no more than 10 cm, preferably no more than 5 cm, long. In this case, the inlet hose of the urine bag, which is usually relatively stiff, can be shortened by half again, that is, to approximately 5 cm or less; a hose adapter which is known in and of itself and which is usually one of the standard accessories that come with the bag is pushed onto its free end. The soft, elastic connecting hose attached to the other end of the adapter gives the connecting section between the collecting container and the urine bag a very high degree of flexibility. As a result, the collecting container can be tipped or pivoted slightly toward the urine bag, which is highly advantageous during use and also later, when the urination device is lifted vertically and set aside.

It is especially advantageous for the flow route between the collecting container and the urine bag to have an open cross section of approximately 8 mm all the way along. This ensures that, during urination, virtually all of the urine flowing into the collecting container flows out again immediately through the outlet connector, passes through the hoses, and arrives in the urine bag, so that, when the urination device or the collecting container is removed after urination there is no danger of spillage, because there is hardly any urine left in the collecting container to spill. The small residue which remains can be sent in its entirety to the urine bag simply by raising the collecting container slightly in the vertical direction.

It is also advantageous for the urine bag to have an inlet valve and an outlet valve known in and of themselves and for the outlet valve to be designed as a rotating one-way valve like a water faucet with a transverse handle. As a result, it is guaranteed that the urine from the urine bag will not flow back out through the hoses into the collecting container. The user can therefore be certain that, after he has held the urination device so that it is hanging vertically from the collecting container, all of the urine has run into the urine bag and that it will be unable to flow back out of it, even if he sets the device down horizontally or even upside down. Before the urination device is put to use, furthermore, it is easy to tell from the position of the actuating cock of the outlet valve whether or not the valve has been properly closed, so that the unwanted escape of urine from the urine bag is reliably prevented.

In addition, the body of the collecting container can be provided with a conically expanding section on the inlet side, or the whole container can taper gently down conically toward the outlet. In addition, the outlet-side end wall of the collecting container can bulge slightly outward to form a funnel, leading in the direction of the outlet connector, which has the effect overall of ensuring the fast and reliable outflow of urine from the collecting container down to the last drop.

In addition, the inlet-side end wall can be given a slant of about 5–10°, so that the top of the end wall is farther toward the rear; the inlet connector is therefore also set back slightly. This improves convenience even more and also increases in particular the resistance to tipping.

During use, the collecting container of the urination device is held by the supine person at an angle of preferably about 30° to the plane of the surface on which he or she is lying or being supported, whereas the connecting hose, the hose adapter, the bag hose, and the urine bag can assume a position between the legs of the user as a linear extension of the collector. The urine bag will thus lie flat on the support surface, and the connecting hose will be curved elastically.

When the urination device is put into service, the collecting container with the urine bag will be put between the legs, with the container toward the front and the bag resting flat on the sheet. The collecting container, provided that it has been set down in the correct position, that is, with the positioning nipple pointing upward, is held in the correct vertical position by the wide, flat urine bag and the very short connecting hoses. The user then grasps the inlet connector and raises the container, for safety's sake verifying again by checking the nipple, which must be pointing directly upward, that the urination device as a whole is in the correct position. The male member is now inserted into the inlet connector. Because of the slightly slanted position of the container, it is ensured that the urine will flow immediately into the bag. It must, of course, be previously noted or checked that the shut-off cock of the outlet valve on the bag is closed. After the user has finished urinating, the collecting container is pushed back a bit, tilted upward and raised, so that the very last residue of urine flows out of the collecting container and into the urine bag. Then the device is set aside without fear that even a single drop of urine will spill. If the user is suffering from mild incontinence, for example, he can set the urination device down onto a spot within arm's reach of the bed or hang it from the bed and use it again several times in succession during the course of the night without having to empty it and clean it each time. It can be emptied and cleaned in the morning, when convenient, after getting up.

The use of the urination device according to the invention in a care facility or hospital setting also means that the amount of work required of the personnel, who are usually overburdened, can be significantly reduced. For example, patients who are bedridden after surgery, but who can easily manage the urination device according to the invention by themselves, can be given their own urination device, which they then can proceed to use as needed. The personnel can collect the used urination devices at some point during the work day or as needed and replace them with new ones. Thus the bedridden person is given the security and simultaneously the satisfaction of being able to urinate without having to wait until a care giver responds to the bell and comes hurrying in with a urination duck.

The design can be made even more compact and user-friendly by extending the inlet connector so that it projects into the interior of the collecting container. Thus a much greater length of the inlet connector rests in or on the container. The connector part projecting outward from the end wall on the inlet side can also be shortened, as a result of which a design even more resistant to tipping and even more compact is obtained.

The shape of the inlet connector can be designed to suit either a male user or a female user. For male users, a straight or slightly tilted or backward-slanted end wall is provided on the inlet side. For female users, the end of the connector on the inlet side is designed to project at the top and at the bottom and to have a recess in the intermediate area which curves in the axial direction, conforming to the female anatomy. Thus two different design variants of the collecting container, i.e., a male collecting container and a female collecting container, can be provided.

It is also possible, however, to provide only a single collecting container for both sexes, in which case an inlet adapter is used, which can be designed in different ways.

Thus, a collecting container with a male inlet connector can be used as the base unit. A tubular, female inlet adapter can be pushed into this inlet connector up as far as an axial stop. This inlet adapter has the appropriate female contour at the end which projects out of the inlet connector after it has been pushed in. Thus, a male urination device can be converted quickly and easily into a female urination device. This is especially advantageous when both male and female persons are intended to use the same device, and the convertibility also represents a cost savings.

A highly advantageous embodiment of the invention is obtained when the inlet connector is designed as a very short retaining collar, in or on which a cylindrical, replaceable inlet adapter is mounted. This inlet adapter can be designed in different ways.

Thus, for one container, two inlet adapters can be provided, namely, a female and a male adapter, which can be inserted into the retaining collar as needed. In particular, the male adapter can also be designed in such a way that it is long enough on the insertion side that it extends relatively far into the interior of the container, as a result of which the inlet connector designed in this way acquires a greater insertion length or horizontal support length. Because this inlet adapter can be easily pulled but again, however, after which only the relatively short retaining collar remains, the interior of the container can also be more easily washed or cleaned out than in the case of a permanently attached inlet connector projecting into the interior of the container.

The inlet adapter, however, can also be designed as a dual inlet adapter; that is, one end of the adapter has a male design and the other end a female design. In this way, a single urination device or a single corresponding collecting container can be provided with an adapter of this kind, which can be easily and quickly converted to suit users of different sexes and which in addition makes it possible for the device to be cleaned more easily and more safely. It is obviously advantageous here also to provide a device for locking the adapter onto the container or on its inlet connector or retaining collar. This guarantees that, if the collecting container is picked up only by the adapter, the container cannot fall off before the last residue of urine has drained out into the urine bag. It is also a good idea to provide a positioning device for the adapter also, so that, especially for use by females, the correct orientation can be guaranteed.

It can also be advantageous for the collecting container to be designed in two parts. The inlet-side end wall, with the inlet connector mounted on it, can be designed as a cap, whereas the essentially cylindrical lateral surface of the container with the outlet-side end wall and the outlet connector forms the second part of the container. As a result, a design which is especially easy to clean is obtained, but appropriate measures must be taken to ensure that the cap is attached in a water-tight manner but still in a manner which is quick, easy, and reliable.

The cap can be designed simply as a disk or, like the lid of a can, it can have a short cylindrical rim, which surrounds the inlet side of the cylindrical body to form a seal or is pushed into the interior of the body, simultaneously forming a seal. Any known type of lid attachment method, such as those known for can lids, can be used. But it is also possible to connect the cap by means of a screw joint or a bayonet joint.

The urination device according to the invention can be used not only by incontinent persons who are bedridden in the postoperative state or because of some disease, but also very successfully by people in wheelchairs and even by highly stressed drivers, who either cannot or will not leave their vehicles.

Of course, the urination device according to the invention can also be used for continuously incontinent patients, in which case a support wedge should be provided, which is used to hold the collecting container at an angle of approximately 30°. In addition, the urine bag in this case should be connected to the collecting container by a hose of appropriate length and set up somewhat lower down than the plane of the bed, so that the continually dripping urine will be able to flow continuously onward into the urine bag. The urine bag can be hung by appropriate devices from the bed frame or laid vertically in an appropriate pocket or basket.

BRIEF DESCRIPTION OF THE DRAWINGS

The invention is explained in greater detail in the following on the basis of several exemplary embodiments illustrated in the figures.

DETAILED DESCRIPTION OF THE PREFERRED EMBODIMENTS

Figure 1:
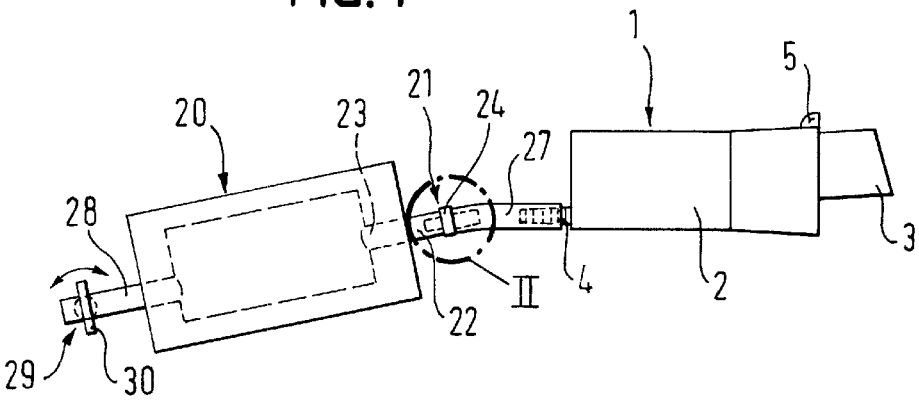
FIG. 1 shows a complete schematic diagram of the urination device with all of its essential individual parts.
Figure 6:
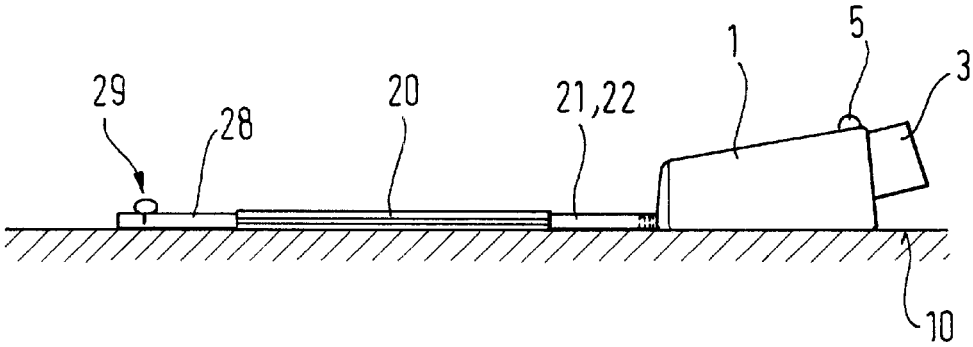
FIG. 6 shows a side view of the device according to FIG. 1 in a horizontal, resting situation with a collecting container of a second design and with direct connection between the urine bag and the hose.
Figure 7:
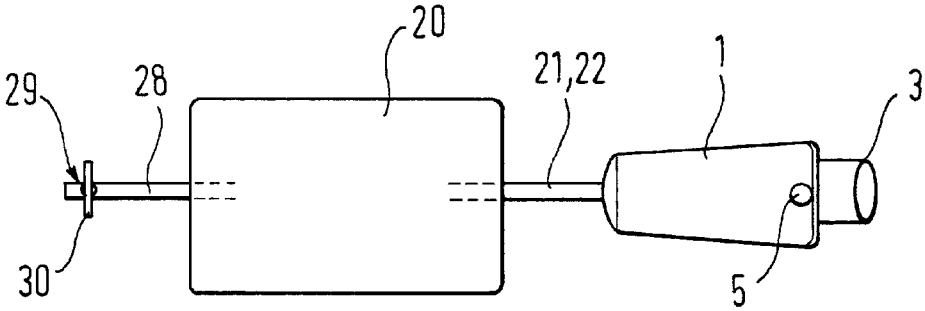
FIG. 7 shows a top view of the device according to FIG. 5.

As can be seen in FIG. 1, the urination device according to the invention consists in general of an essentially cylindrical collecting container 1, to which a standard commercial urine bag 20 is attached in replaceable fashion by hose connecting elements 21 known in and of themselves. The hose connecting elements 21 consist here of a very short inlet hose 22 of the standard commercial urine bag, which opens out into the bag via an inlet valve 23, usually a lip valve. At the free end of the hose 22, a hose adapter 24 is pushed on, which is usually sold along with the urine bag and which is shown in more detail in FIG. 2. A soft, elastic connecting hose 27 represents the flexible connection between the adapter 24 and the outlet connector 4 of the collecting container 1. The urine bag 20, however, can also be attached directly via the free end of the inlet hose 22 to the outlet connector 4 of the collecting container, as shown in FIGS. 6 and 7. Because the inlet hoses of the urine bags are not usually very flexible, however, it is recommended that a short, soft, connecting hose 27 be inserted in between. The outlet hose 28 of the urine bag 20 is provided with a one-way, rotating outlet valve 29, which has a cock 30 with a handle, so that it is easy to tell whether the valve is in the open or in the closed position. The collecting container 1 consists essentially of a cylindrical body 2, which has an outlet connector 4 at one end and an inlet connector 3 at the other end, which are located diagonally opposite each other, off-center, as will be explained in more detail in connection with FIG. 3.

Figure 2:
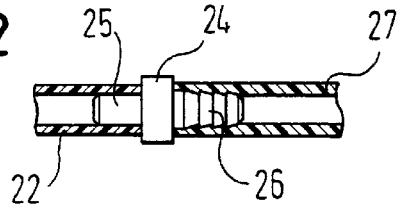
FIG. 2 shows a side view of a detail in FIG. 1.

As can be seen in FIG. 2, the hose adapter 24 has at one end a hose bush 25, onto which the inlet hose 22 of the urine bag is pushed. At the axially opposite end is a hose connector 26, onto which the soft, elastic connecting hose 27 is firmly pushed.

Figure 3:
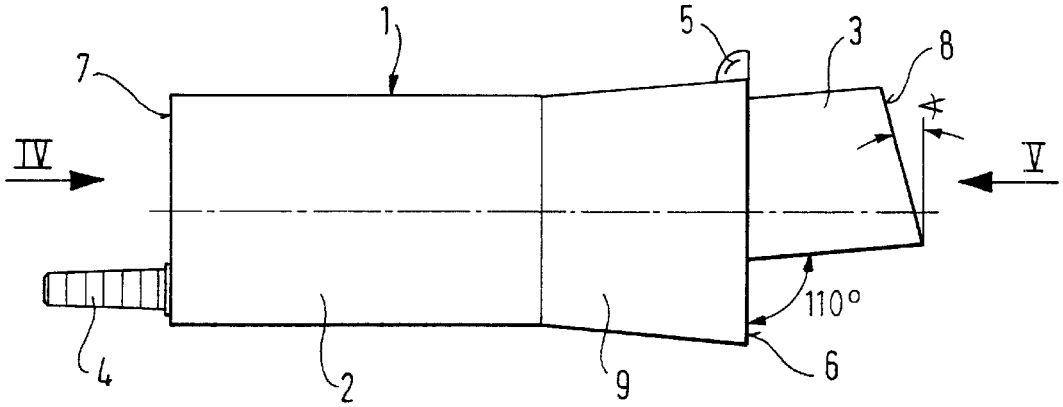
FIG. 3 shows a side view of a first design of a collecting container for the device according to FIG. 1.
Figure 4:
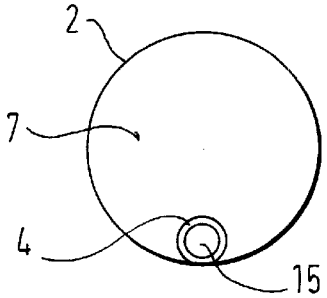
FIG. 4 shows an end view looking in the direction of arrow IV in FIG. 3.
Figure 5:
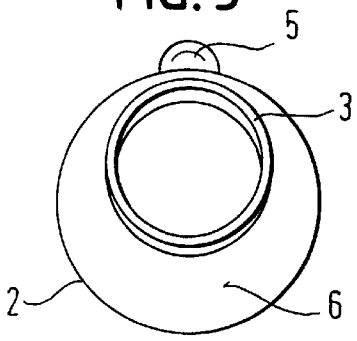
FIG. 5 shows an end view looking in the direction of arrow V of FIG. 3.

FIG. 3 shows a first embodiment of the collecting container 1, which is preferably made of rigid plastic, and which consists essentially of a tubular body 2 (with approximate dimensions of*60×100 mm) with a conically expanding section 9 (approximately*60/65×53 mm). The body 1, however, can also be designed to taper gently as a whole in conical fashion, as in the case of the exemplary embodiment according to FIG. 9. At the top of the section 9 there is a positioning nipple 5, which is used for orientation when the container 1 is being used. The dimensions of the collecting container are thus very small in comparison to those of the known collecting containers; a body diameter of approximately 60–90 mm and a body length of approximately 130–200 mm, preferably 150 mm, have been found to be extremely convenient. On the end wall 6 on the inlet side, an inlet connector 3 (approximately*45×45 mm) is attached at an angle of approximately 110° to the end wall; this connector is in an off-center position, i.e., its axis is shifted radially upward, and it has a bevel 8 on the end surface, as is easy to see in the end view of FIG. 5. On the outlet-side end wall 7 there is a hose connector 4 (approximately*10/8×30 mm), which is off-center toward the bottom in such a way that the bottom surfaces of the inside openings of the container body and the outlet connector are essentially in alignment with each other, as can be seen in the end views of FIGS. 4 and 10.

Figure 8:
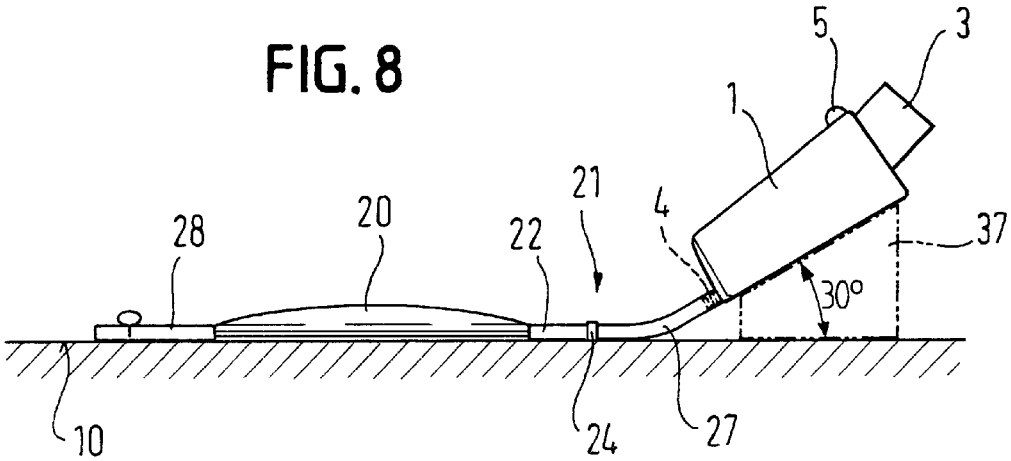
FIG. 8 shows a view like that of FIG. 6 with the collecting container and connecting hose in the raised position ready for duty.

FIGS. 6–8 show the urination device in the position it is in when it is being used.

Thus FIG. 6 shows the device lying flat on a flat support surface 10; it can be seen that the other components following along after the collecting container 1, namely, the connecting hoses 21, 22 and the urine bag 20, are also resting flat on the surface.

It can also be seen from FIG. 6 that the relatively wide urine bag 20, especially because of the short length of the connecting hose, which consists here merely of the inlet hose 22, simultaneously serves as a position stabilizer for the container 1. That is, when the urine bag 20 is laid flat on a level surface or on the support surface 10, it holds the container 1 firmly in the inserted position via the hose connection 21. Therefore, when the two main components, namely, the collecting container and the urine bag, are connected to each other by the hose connecting elements, it is very important that the two parts be in the correct position with respect to each other.

FIG. 8 shows the device in the active use position, that is, with the collecting container 1 being held at an angle of approximately 30°. The elastic connecting hose 27, which, as also shown in FIG. 1, is inserted between the urine bag inlet hose 22 and the container outlet connector 4, is what makes it possible for this angled position to be assumed with practically no resistance. It is easy to see that the angle can be freely selected by the user as needed; simply because human bodies come in different sizes, different angles might have to be chosen. In addition, a smaller angle must be chosen when the device is to be used by a female user.

Figure 9:
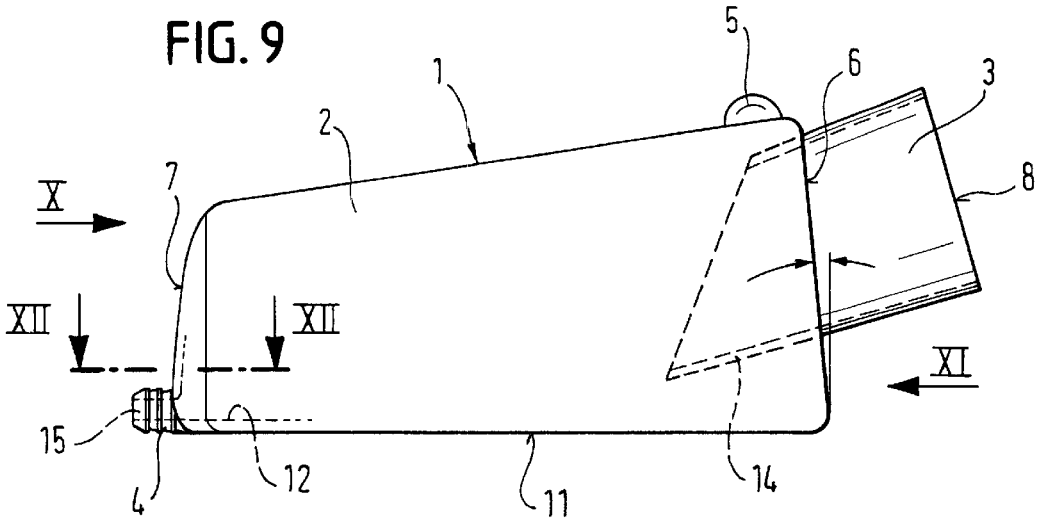
FIG. 9 shows a side view of a collecting container according to the second design.
Figure 10:
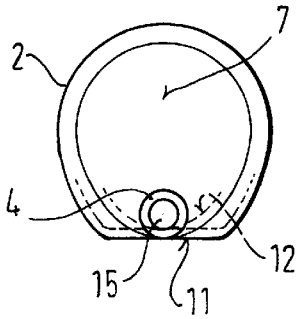
FIG. 10 shows an end view looking in the direction of arrow X in FIG. 9.
Figure 11:
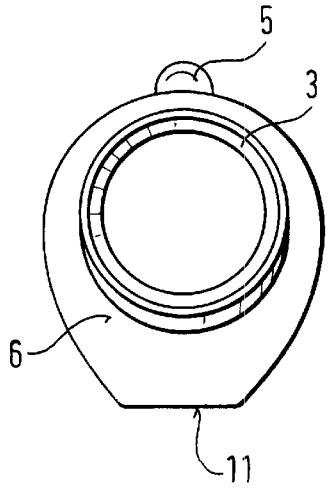
FIG. 11 shows an end view looking in the direction of arrow XI in FIG. 9.

In the case of the additional exemplary embodiment of the collecting container 1 shown in FIGS. 9–12, it can be seen; first, that the entire body 2 is slightly conical, the side 11 which makes contact with the support surface being slightly flattened. This flattening is wider at the inlet end and narrower toward the outlet end, by which point it has become completely round, as can be seen in FIGS. 10 and 11.

Figure 12:
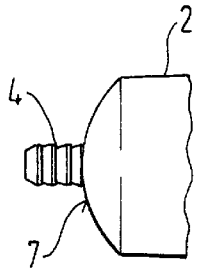
FIG. 12 shows a partial cross section along line XII—XII of FIG. 9, illustrating the funnel-shaped bulge in the outlet-side end wall.

It can also be seen from FIG. 9 in conjunction with FIGS. 10 and 12 that the outlet-side end wall 7 has a rounded or bulging area, which extends in one direction toward the outlet connector 4, so that a shape similar to half of a shallow funnel is produced. The outlet connector is designed so that the lateral surface sections of the connector opening 15 on the outlet side are aligned with the surfaces of the opening 12 on the inside of the container body 2.

As can be seen from FIG. 9, furthermore, the inlet connector 3 has an extension 14, which projects into the interior of the container. The extension 14 here has a bevel proceeding down from the top, so that a trough-like contact wall is present chiefly at the bottom. It is also possible for this extension of the inlet connector to be in the form of complete cylinder or in the form of just the lower half of the connector, i.e., in the form of a trough.

Additional embodiments of the inlet connector, i.e., of the inlet side of the connector, are shown in FIGS. 13–18.

Figure 13:
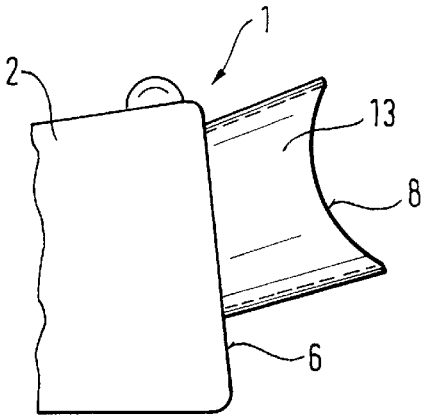
FIG. 13 shows a partial side view of a collecting container according to FIG. 9 with a female inlet connector.

Thus, FIG. 13 shows an inlet connector 13, the end 8 of which conforms to the female anatomy. That is, a curved recess is cut into the end proceeding in the axial direction, symmetrical to a line passing horizontally through the center of the connector.

Figure 14:
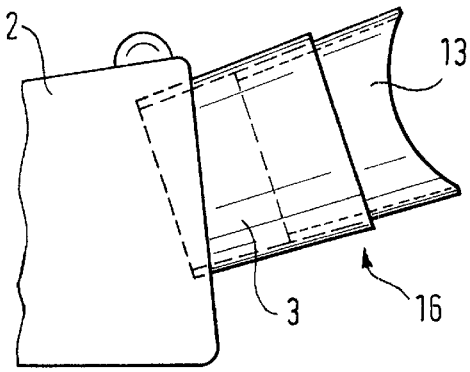
FIG. 14 shows a partial side view of a collecting container according to FIG. 9 with a male inlet connector and an inserted female inlet adapter.

FIG. 14 shows the inlet-side end of a collecting container 1 with a male inlet connector 3, into which an adapter 16 has been inserted, which has a female inlet connector part 13 at its outer end. Thus a male urine container can be quickly and easily converted into a female one.

Figure 15:
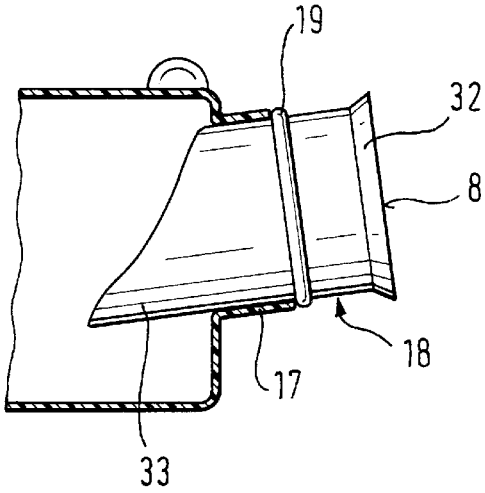
FIG. 15 shows a vertical cross section through a collecting container on the inlet side in a design with a short retaining collar and a male inlet adapter.
Figure 16:
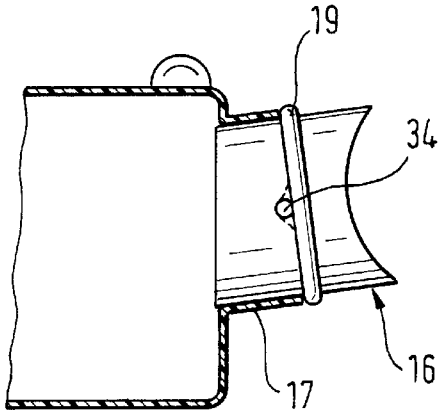
FIG. 16 shows a cross-sectional view like that of FIG. 15 but with a female inlet adapter.
Figure 17:
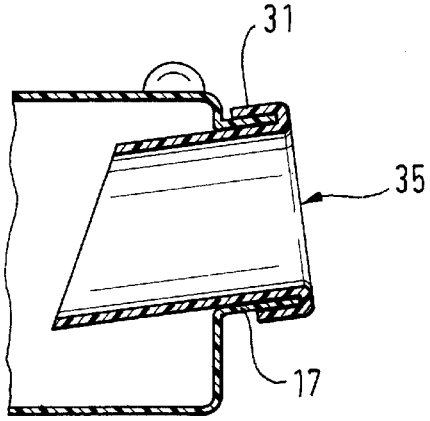
FIG. 17 shows a cross-sectional view like that of FIG. 15 with a male inlet adapter of a different design.

FIGS. 15–17 show exemplary embodiments in which, instead of the longer inlet connector 3, 13, there is only a relatively short retaining collar 17 present, which plays here merely the role of a receptacle or holder for different inlet adapters.

Thus, in the case of the embodiment shown in FIG. 15, a male adapter 18 is provided, which has a stop ring 19 on its outside lateral surface. Instead of a complete ring, it would also be enough to provide a single stop pin or knob instead.

This adapter 18 has a conical expansion, serving as an guide bevel 32, on the inlet end, whereas the other end of the adapter projects essentially in the form of a trough 33 into the interior of the container.

FIG. 16 shows that the female adapter 16, also shown in FIG. 14, can be used not only for collecting containers with a male outlet connector 3 but also for collecting containers with a short retaining collar 17. In addition, a positioning aid 34 is also suggested in the drawing, which can consist of a pin cooperating with a corresponding slot, so that the inlet end is always positioned correctly. A positioning pin of this type is also to be provided in the other exemplary embodiments with an inlet adapter, insofar as the ends of these adapters are made asymmetric or nonperpendicular to improve their function.

FIG. 17 shows an adapter 35, the inlet end of which consists merely of a flanged rim 31, which surrounds the retaining collar 17. In this case, the other end of the adapter 35 projects relatively far into the interior of the container and thus represents a good support surface for the male organ, although on the inlet side, measuring from the inlet-side end wall 6, there is only a short stump, somewhat longer overall than the retaining collar 17, projecting out from the wall. Thus an especially short, compact design is obtained, which virtually eliminates the danger of tipping. The danger of spilling is also almost completely eliminated, because, as a result of the dual-tube design on the inlet side, any small residues of urine which may still remain cannot flow directly out over the series of steps thus formed.

Figure 18:
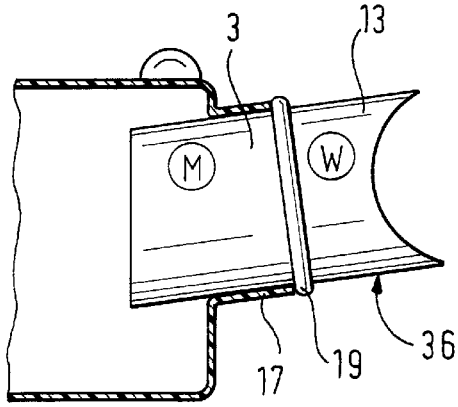
FIG. 18 shows a partial cross-sectional view like that of FIG. 15 with a dual-gender, convertible dual inlet adapter.

Finally, FIG. 18 shows a dual adapter 36, which has a female inlet connector 13 at one end and a male inlet connector 3 at the other end, which are separated by an appropriate stop 19.

When inlet adapters are used, an attachment device (not shown) can obviously be used also to hold the adapter firmly on the retaining collar 17, for example, so that, if the user were to mistakenly grip the collecting container by the adapter in the attempt to lift the container, the adapter will not come loose from the container and the container will not fall.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A urination device, comprising:

a collecting container having an essentially cylindrical hollow body with an inlet-side end wall and an outlet-side end wall essentially perpendicular to a longitudinal axis of the container and having a body diameter of about 60–90 mm and a body length of about 130–150 mm, the collecting container further having a cylindrical inlet connector projecting upward at an angle from the inlet-side end wall and an outlet connector at a bottom edge of the outlet side end wall, the cylindrical inlet connector at the inlet-side end wall being arranged to project upward from an off-center point on the wall, diagonally opposite a point where the outlet connector is installed in the outlet-side end wall, the inlet connector being no more than ⅓ a length of the collecting container and forming an angle of about 20° to the axis of the container so that a top front edge of the inlet connector does not project radially substantially beyond a top front edge of the hollow body of the collecting container; and a urine bag having an inlet valve, a switchable outlet valve and an inlet hose, the inlet hose being detachably connected to the outlet connector of the collecting container, the inlet hose having a length of no more than 10 cm.

2. A device according to claim 1, wherein the collecting container has a diameter of approximately 70 mm and a length of approximately 150 mm, the inlet connector having a diameter of approximately 45 mm and a length of approximately 45 mm.

3. A device according to claim 1, wherein an upward-projecting, easy-to-grip positioning nipple is arranged on a top edge of the inlet end of the collecting container body when the device is positioned, for use.

4. A device according to claim 1, wherein the inlet hose of the urine bag is pushed directly onto the outlet connector of the collecting container.

5. A device according to claim 1, and further comprising a hose adapter pushed onto a free end of the inlet hose, and a connecting hose between the outlet connector and one of the urine bag and the hose adapter, the connecting hose having a maximum length of 10 cm.

6. A device according to claim 5, wherein the collecting container is at an angle of approximately 30° to a plane of a support surface during use so that the connecting hose, the hose adapter, the bag inlet hose, and the urine bag rest between legs of a user as a linear extension of the collecting container, the urine bag resting flat and the connecting hose being elastically curved.

7. A device according to claim 1, wherein a flow route between the collecting container and the urine bag has a continuous open cross section of about 8 mm.

8. A device according to claim 1, wherein the outlet valve of the urine bag is a rotating one-way valve with a transverse handle.

9. A device according to claim 1, wherein the body of the collecting container has a conically expanding section on the inlet end, the outlet connector being a hose connector with an external surface which tapers down one of conically and in graduated steps.

10. A device according to claim 1, wherein the body of the collecting container has an overall slight conical taper, the outlet connector being a hose connector with an external surface which tapers down one of conically and in graduated steps.

11. A device according to claim 1, wherein the outlet-side end wall of the collecting container has a slightly funnel-shaped bulge pointed toward the outlet connector, and the inlet-side end wall is slanted at an angle of about 5–10°.

12. A device according to claim 1, wherein the inlet connector is configured to extend into an interior of the collecting container.

13. A device according to claim 1, wherein the collecting container is formed in two parts, including a first part formed by the inlet-side end wall with the inlet connector, and a second part formed by an essentially cylindrical lateral surface of the body with the outlet-side end wall and the outlet connector, the first part being detachably attached as a cap in a water-tight manner to the second part.

14. A device according to claim 13, wherein the cap has a short, cylindrical rim, which surrounds the inlet side of the cylindrical body to form a seal with it.

15. A device according to claim 1, wherein the inlet connector has one of a straight and slightly slanted end surface on the inlet side so as to accommodate male users.

16. A device according to claim 15, and further comprising an essentially cylindrical tubular female inlet adapter which is pushable into the male inlet connector as far as an axial stop so that after the female adapter is inserted into the inlet connector, an end projecting from the inlet connector has a shape which conforms to the female anatomy.

17. A device according to claim 1, wherein a very short retaining collar is provided as the inlet connector in the inlet-side end wall, an essentially cylindrical dual inlet adapter being inserted one of in and on the collar in a replaceable manner.

18. A device according to claim 17, wherein the dual inlet adapter can be mounted one way in the retaining collar and also flipped 180° and mounted another way, with a female design at a first end and a male design at a second end, and which has an external positioning and gripping ring essentially in a center.

19. A device according to claim 1, wherein a bottom support side of the collecting container is formed as a narrow, flattened support surface.

20. A device according to claim 1, wherein the inlet connector has an end surface configured to project at the top and at the bottom and an area in between the top and bottom being recessed in an arc shape corresponding to female anatomy so as to accommodate female users.

* * * * *